US011192699B2

(12) United States Patent
French et al.

(10) Patent No.: US 11,192,699 B2
(45) Date of Patent: Dec. 7, 2021

(54) PACKAGE

(71) Applicant: Berry Global, Inc., Evansville, IN (US)

(72) Inventors: Jordan Robert French, Evansville, IN (US); Seth Tempel, Evansville, IN (US)

(73) Assignee: BERRY GLOBAL, INC., Evansville, IN (US)

( * ) Notice: Subject to any disclaimer, the term of this patent is extended or adjusted under 35 U.S.C. 154(b) by 120 days.

(21) Appl. No.: 16/295,200

(22) Filed: Mar. 7, 2019

(65) Prior Publication Data

US 2019/0276200 A1 Sep. 12, 2019

Related U.S. Application Data

(60) Provisional application No. 62/639,647, filed on Mar. 7, 2018.

(51) Int. Cl.

| | |
|---|---|
| ***B65D 43/22*** | (2006.01) |
| ***B65D 50/00*** | (2006.01) |
| ***B65D 25/08*** | (2006.01) |
| ***B65D 43/16*** | (2006.01) |
| ***B65D 50/04*** | (2006.01) |
| ***B65D 41/04*** | (2006.01) |

(52) U.S. Cl.

CPC ..... *B65D 43/22* (2013.01); *B65D 25/08* (2013.01); *B65D 41/0485* (2013.01); *B65D 43/162* (2013.01); *B65D 50/00* (2013.01); *B65D 50/043* (2013.01); *B65D 50/046* (2013.01); *B65D 2543/00805* (2013.01); *B65D 2543/00814* (2013.01)

(58) Field of Classification Search

CPC .. B65D 43/22; B65D 43/162; B65D 41/0485; B65D 50/046; B65D 50/043; B65D 50/00; B65D 25/08; B65D 2543/00814; B65D 2543/00805

USPC ..... 220/281, 367.1, 608; 215/215, 206, 209

See application file for complete search history.

(56) References Cited

U.S. PATENT DOCUMENTS

| | | | | |
|---|---|---|---|---|
| 3,703,975 | A | 11/1972 | Wittemer | |
| 1,480,762 | A | 11/1984 | Thomas | |
| 4,752,014 | A | 6/1988 | House et al. | |
| 5,230,433 | A * | 7/1993 | Hamilton | B65D 50/046 215/221 |
| 5,449,077 | A | 9/1995 | Seidler | |
| 5,449,078 | A | 9/1995 | Akers | |
| 5,603,421 | A | 2/1997 | Opresco | |
| 5,908,125 | A | 6/1999 | Opresco | |
| 5,927,528 | A | 7/1999 | Jones | |
| 6,076,689 | A | 6/2000 | Vassallo | |
| 6,439,409 | B1 | 8/2002 | Dresel et al. | |
| 6,679,381 | B1 | 1/2004 | Bush | |
| 7,549,541 | B2 | 6/2009 | Brozell et al. | |
| 8,066,122 | B2 | 11/2011 | Beecroft et al. | |
| 8,220,636 | B2 | 7/2012 | Beecroft et al. | |
| 8,292,110 | B2 | 10/2012 | Rutter et al. | |

(Continued)

OTHER PUBLICATIONS

Non Final Office Action of U.S. Appl. No. 16/295,182 dated Aug. 25, 2020, all enclosed pages cited.

(Continued)

*Primary Examiner* — Ernesto A Grano

(57) ABSTRACT

A package having a container and a selectively openable lid to selectively allow access to the container is disclosed.

14 Claims, 17 Drawing Sheets

(56) References Cited

U.S. PATENT DOCUMENTS

| | | | |
|---|---|---|---|
| 8,839,803 | B2 | 9/2014 | Holloway |
| 9,694,955 | B2 | 7/2017 | Wu et al. |
| 9,878,821 | B2 | 1/2018 | Sibley |
| 9,895,698 | B2 | 2/2018 | Spielman |
| 2010/0025355 | A1 | 2/2010 | Beecroft |
| 2011/0000814 | A1 | 1/2011 | Lee et al. |
| 2011/0259783 | A1 | 10/2011 | Angelucci et al. |
| 2016/0039591 | A1 | 2/2016 | Kinzer |
| 2016/0090213 | A1 | 3/2016 | Murray |
| 2017/0007004 | A1 | 1/2017 | Burditt, Jr. et al. |
| 2017/0027168 | A1 | 2/2017 | Heath |
| 2017/0112181 | A1 | 4/2017 | Belfance et al. |
| 2017/0113841 | A1 | 4/2017 | Murray |
| 2017/0319009 | A1 | 11/2017 | Seckel et al. |
| 2017/0349338 | A1 | 12/2017 | Ziering et al. |
| 2018/0042890 | A1 | 2/2018 | Sinai et al. |

OTHER PUBLICATIONS

Non Final Office Action of U.S. Appl. No. 16/295,197 dated Jun. 15, 2020, all enclosed pages cited.

Non Final Office Action of U.S. Appl. No. 16/295,202 dated May 28, 2020, all enclosed pages cited.

Leafs by Snoop—Pentagram, [online]. Pentagram, 1972 [retrieved on May 16, 2019]. Retrieved from the Internet: <URL: www.pentagram.com/work/leafs-by-snoop-1.html>.

Leafs by Snoop, [online]. [retrieved on May 16, 2019]. Retrieved from the Internet: <URL: www.leafsbysnoop.com/home/.html>.

Final Office Action of U.S. Appl. No. 16/295,192 dated Feb. 8, 2021, all enclosed pages cited.

* cited by examiner

PACKAGE

PRIORITY CLAIM

This application claims priority under 35 U.S.C. § 119(e) to U.S. Provisional Application Ser. No. 62/639,647, filed Mar. 7, 2018, which is expressly incorporated by reference herein.

TECHNICAL FIELD

The present disclosure relates generally to a container, and more specifically to a container for storing perishables that has features for resisting undesired opening.

BACKGROUND

It is often desirable to provide a container for storing items, which may include perishable items, that also has features that make opening it child resistant.

SUMMARY

Certain embodiments according to the present disclosure provide a package with one or more selectively openable and/or closable lid portions.

In one aspect, for instance, a package is provided that includes a container having a floor and a side wall that cooperate to form a product storage region. The package also includes a lid that is movable between a closed position in which the lid is at least partially blocking access to the product storage region, and an open position in which the lid is at least partially moved away from the closed position such that the product storage region is accessible by a user. The container includes at least one pair of opposed depressible buttons coupled to at least one pair of container blocking tabs, wherein in a relaxed state the at least one pair of container blocking tabs are configured to retain the lid in a locked state, and in a compressed state the at least one pair of container blocking tabs are configured to allow the lid to move from the closed position to the open position. The lid includes at least one pair of opposed lid blocking tabs configured to abut the at least one pair of opposed container blocking tabs when the lid is coupled to the container and the at least one pair of opposed container blocking tabs are in the relaxed state.

In another aspect, a package is provided that includes a container having a floor and a first side wall that cooperate to form a product storage region. The package also includes a lid that is movable between a closed position in which the lid is at least partially blocking access to the product storage region, and an open position in which the lid is at least partially moved away from the closed position such that the product storage region is accessible by a user. The container includes at least one pair of opposed depressible buttons coupled to at least one pair of container blocking tabs, wherein in a relaxed state the at least one pair of container blocking tabs are configured to retain the lid in a locked state, and in a compressed state the at least one pair of container blocking tabs are configured to allow the lid to move from the closed position to the open position. The lid includes at least one pair of opposed lid blocking tabs configured to abut the at least one pair of opposed container blocking tabs when the lid is coupled to the container and the at least one pair of opposed container blocking tabs are in the relaxed state. The container includes at least one second side wall around a cavity formed between the first side wall and the second side wall, wherein each depressible button is at least partially surround by a slit to facilitate depression of that depressible button, and wherein the slit is in fluid communication with the cavity.

In yet another aspect, a package is provided that includes a container having a floor and a first side wall that cooperate to form a product storage region. The package also includes a lid that is movable between a closed position in which the lid is at least partially blocking access to the product storage region, and an open position in which the lid is at least partially moved away from the closed position such that the product storage region is accessible by a user. The container includes at least one pair of opposed depressible buttons coupled to at least one pair of container blocking tabs, wherein in a relaxed state the at least one pair of container blocking tabs are configured to retain the lid in a locked state, and in a compressed state the at least one pair of container blocking tabs are configured to allow the lid to move from the closed position to the open position. The lid includes at least one pair of opposed lid blocking tabs configured to abut the at least one pair of opposed container blocking tabs when the lid is coupled to the container and the at least one pair of opposed container blocking tabs are in the relaxed state. The container includes at least one second side wall around a cavity formed between the first side wall and the second side wall, wherein each depressible button is at least partially surround by a slit to facilitate depression of that depressible button, and wherein the slit is in fluid communication with the cavity. The second side wall and each depressible button has an outside diameter great than an outside diameter of the first side wall of the container.

BRIEF DESCRIPTION OF THE DRAWINGS

Embodiments now will be described more fully hereinafter with reference to the accompanying drawings, in which some, but not all embodiments may be shown. Indeed, embodiments may be illustrated or described in many different forms and the present disclosure should not be construed as limited to the embodiments set forth herein. Like numbers refer to like elements throughout, and wherein.

DETAILED DESCRIPTION

Embodiments now will be described more fully hereinafter with reference to the accompanying drawings, in which some, but not all embodiments may be shown. Indeed, embodiments may take many different forms and the present disclosure should not be construed as limited to the embodiments set forth herein. As used in the specification, and in the appended claims, the singular forms "a", "an", "the", include plural referents unless the context clearly dictates otherwise.

The terms "substantial" or "substantially" may encompass the whole as specified, according to certain embodiments, or largely but not the whole specified according to other embodiments.

Figure 1:
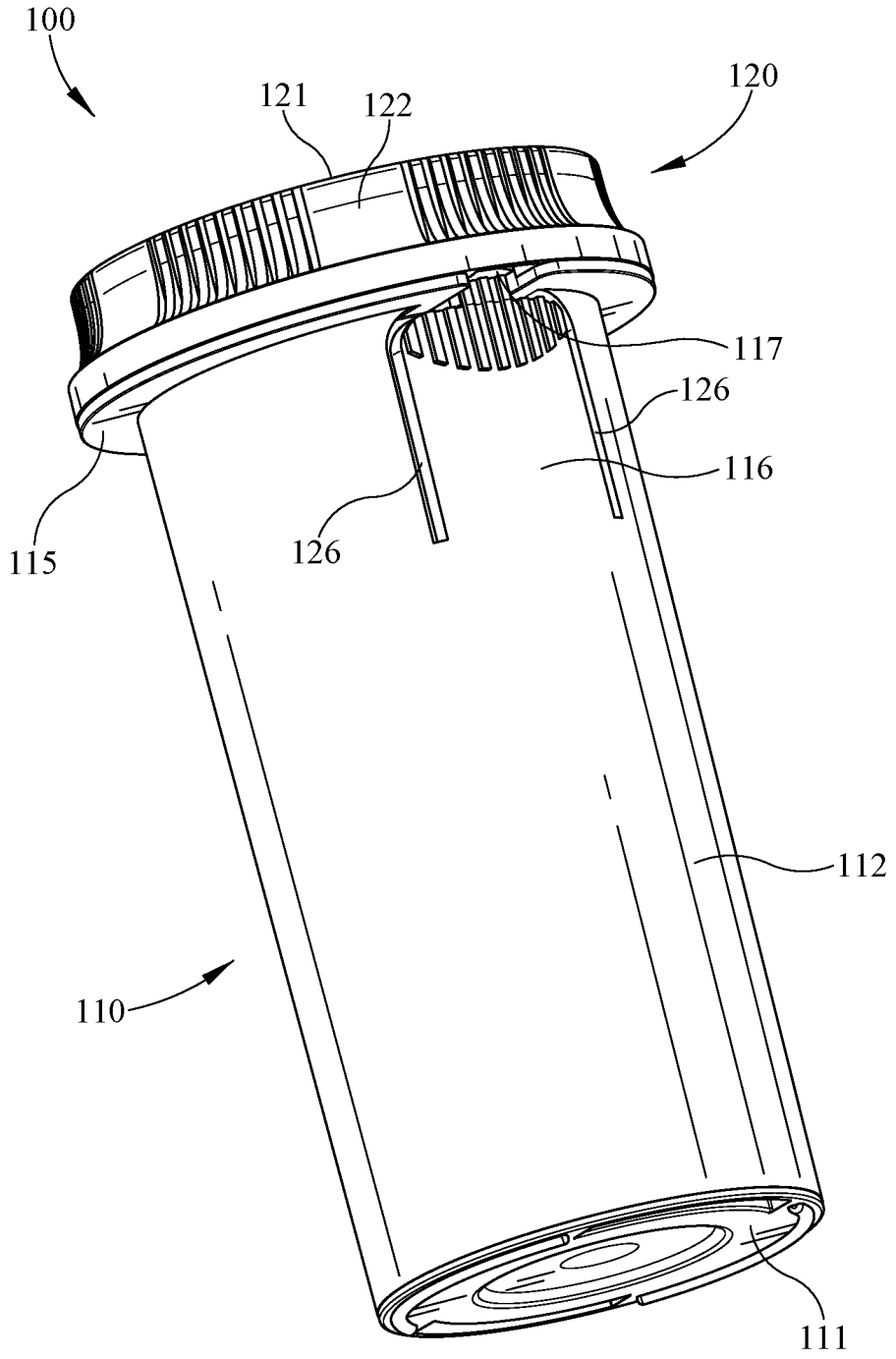
FIG. 1 illustrates a bottom perspective view of an embodiment of a package in a closed position.

Some embodiments of a package 100 may include a container 110 and/or a lid 120, as shown in FIG. 1. Lid 120 may be selectively openable relative to container 110 to allow access to and/or egress from an interior region of container 110. The interior region of container 110 may be at least partially defined by a container floor 111 and a container side wall 112. Lid 120 may include a top 121 and a side wall 122 coupled to top 121. Lid 120 may be positionable between a closed position, substantially covering the interior region of container 110, and an open position, allowing access to interior region of container 110. Lid 120 may be selectively removably attached to container 110. For example, lid 120 may be rotationally removable from and/or attachable to container 110. For example, clockwise rotation of lid 120 relative to container 110 may attach, couple, fasten, and/or tighten lid 120 on container 110, and counter-clockwise rotation may loosen and/or remove lid 120 from container 110, or vice versa.

Figure 2:
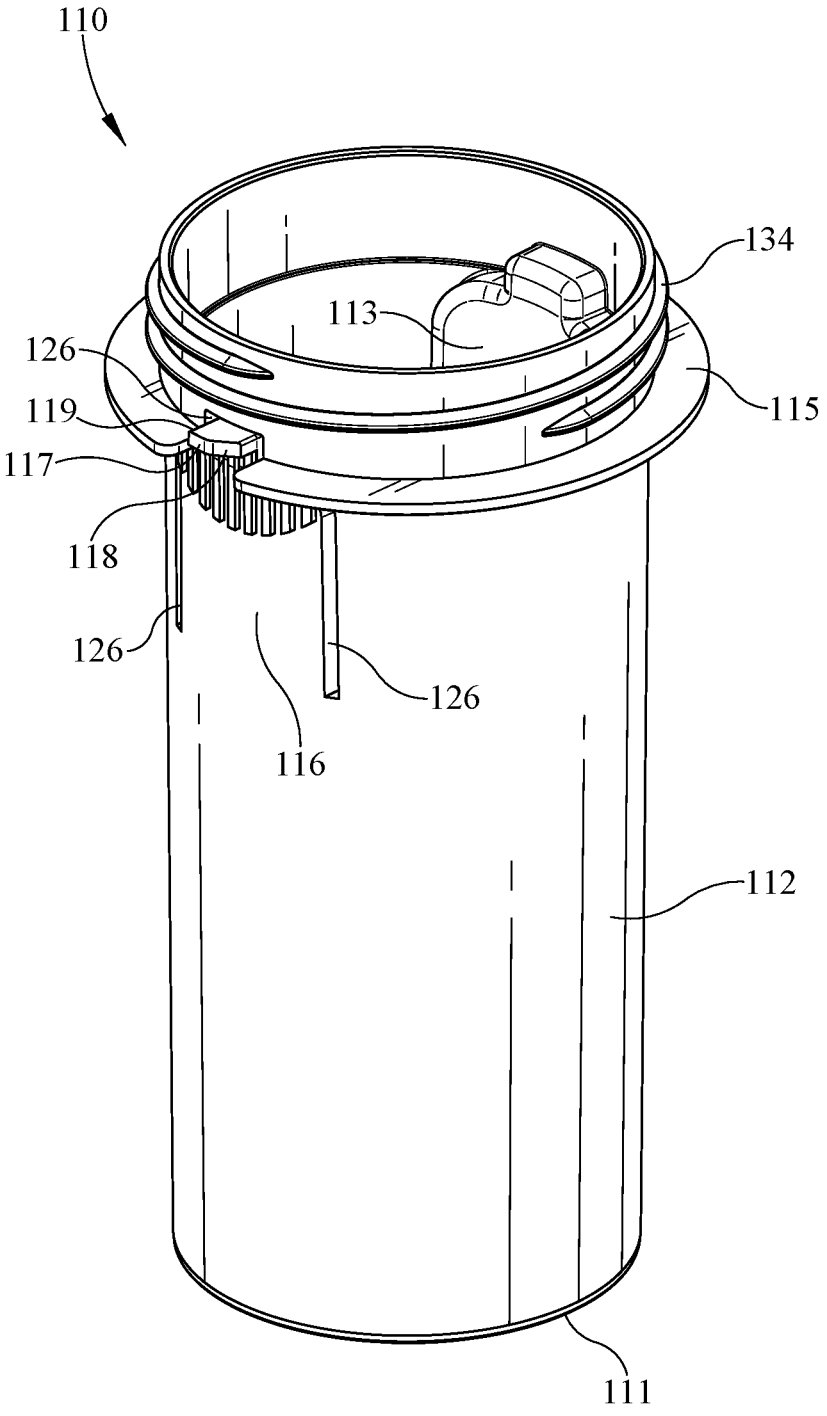
FIG. 2 illustrates a perspective view of a container according to the package of FIG. 1.
Figure 3:
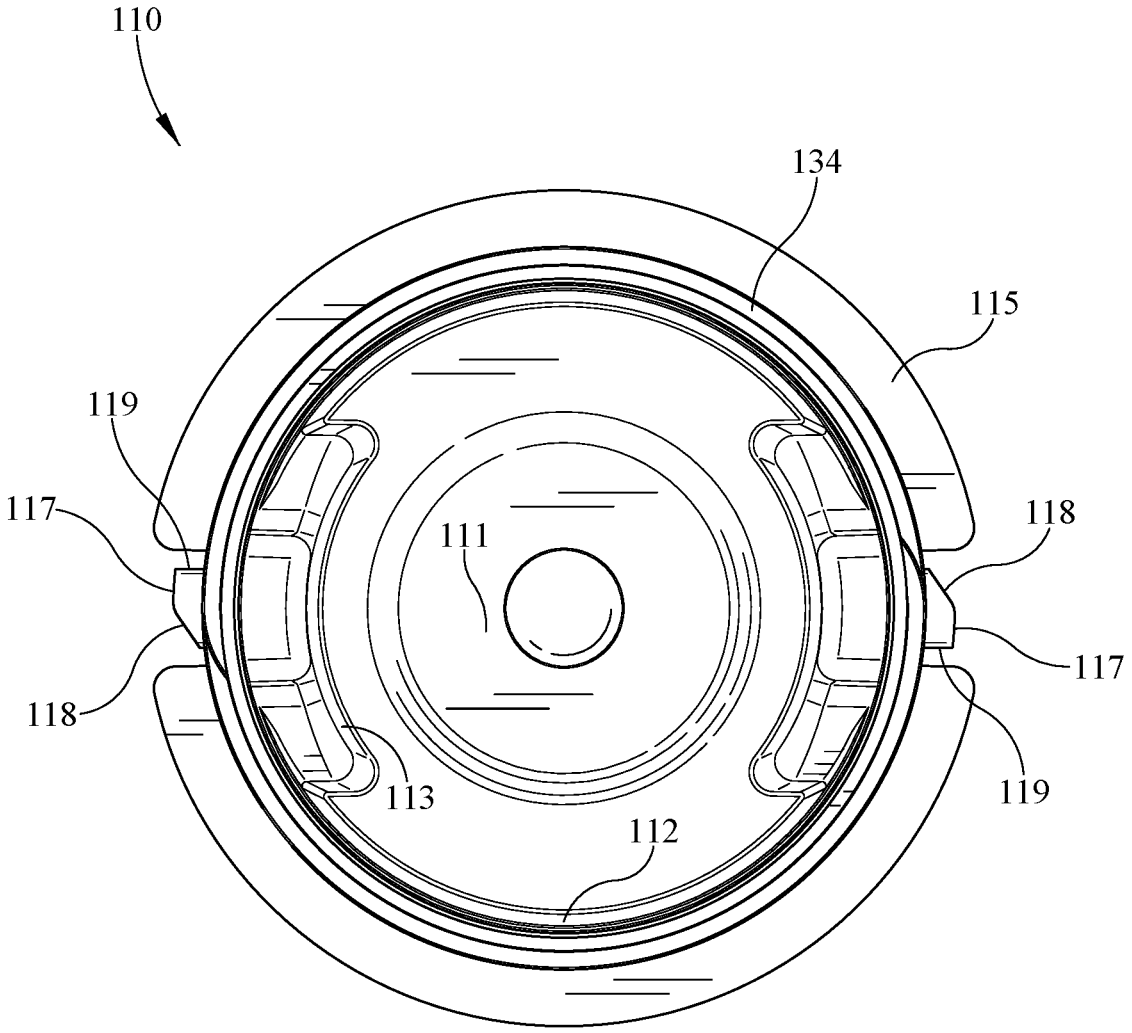
FIG. 3 illustrates a top view of the container of FIG. 2.
Figure 4:
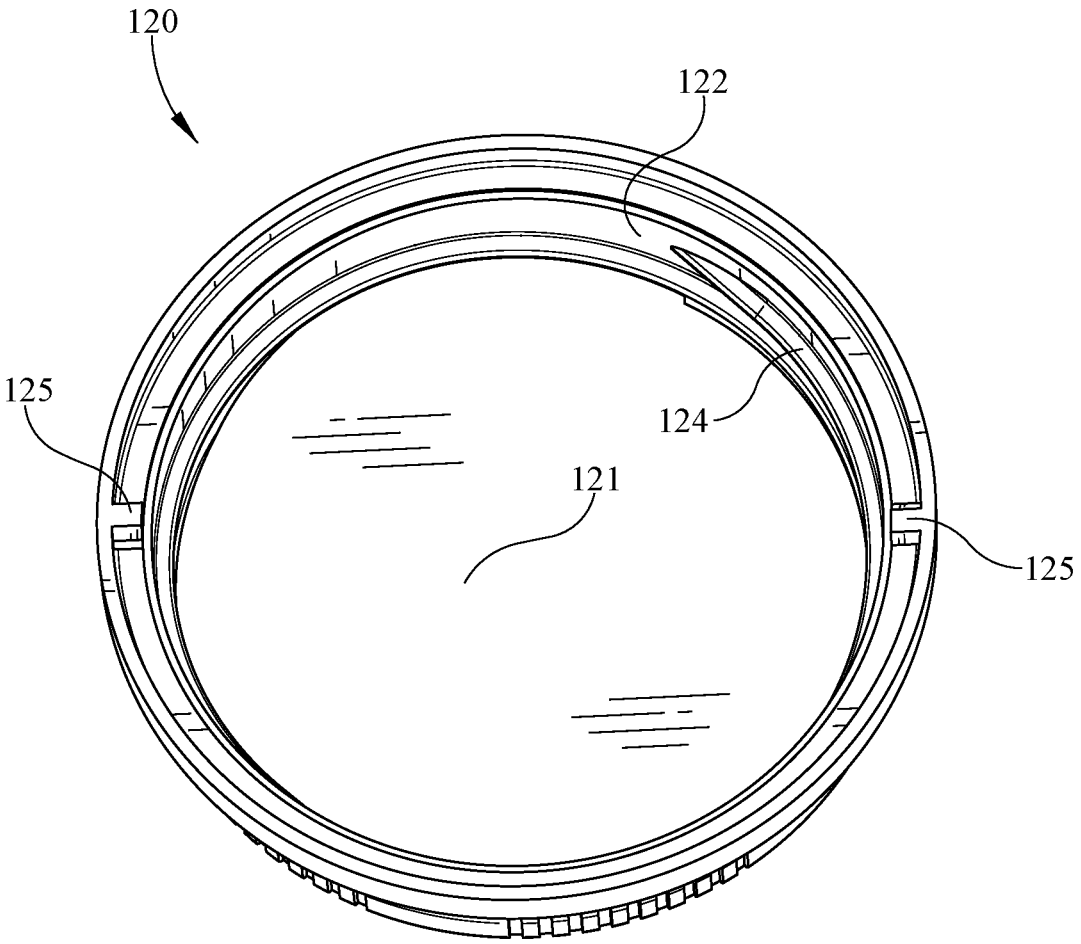
FIG. 4 illustrates a perspective view of a lid according to the package of FIG. 1.

One or more container blocking tabs 117 may be provided, such as those shown in FIGS. 2 and 3, for any of a variety of reasons, including but not limited to providing a locking mechanism and/or a child resistant opening feature. For example, a latching, locking, and/or blocking mechanism may be provided that prevents or inhibits rotational motion of lid 120 that would loosen or remove it from container 110. A user may selectively overcome this latching, locking, and/or blocking mechanism, for example, by actuating one or more areas or buttons 116. It is understood that tightening or attachment of lid 120 to container 110 could be provided by either clockwise or counter-clockwise rotation, with the opposite rotation resulting in loosening or removal of lid 120 from container 110, in embodiments using a threaded engagement such as is shown in FIGS. 2-4.

If included, container blocking tab 117 may interact, engage, and/or block a corresponding structure of lid 120. Lid 120 may include one or more lid blockers or lid blocking tabs 125, for example, which may be the corresponding structure that interacts with container blocking tabs 117. When package 100, container 110, and/or lid 120 is in a resting state in a closed position, container blocking tabs 117 and lid blocking tabs 125 may align so as to prevent rotation of lid 120 relative to container 110. A user may overcome this blocking mechanism by pressing buttons 116 and deflecting container blocking tabs 117 inwardly enough to move them out of blocking alignment with lid blocking tabs 125 and allowing rotation of lid 120 relative to container 110. A user may actuate areas or buttons 116 to remove the blocking mechanism, then may rotate lid 120 to loosen and/or remove it and gain access to the interior region of container 110.

As shown in FIG. 2, button 116 may be coupled to or extend from side wall 112 upwardly to form a deflectable cantilever-type member. Button 116 may be partially surrounded by discontinuity, opening, or slit 126, for example on all sides except at least a portion of the bottom of button 116 to form the deflectable or compressible cantilever-type member. A user may depress or compress button 116 to cause flexure and/or inward deflection of button 116 and container blocking tab 117. It is understood that while the discontinuity around button 116 is shown as slit 126, it could alternatively be a thin or flexible material that may still allow flexure or inward deflection of button 116 and/or container blocking tab 117. Container 110 may include a lip 115 between container side wall 112 and a container thread 134 for any of a variety of reasons, including but not limited to providing a surface against which lid 120 may approach or rest when lid 120 is attached or fastened to container 110.

Container blocking tab 117 may include a cam surface or angled or beveled edge 118 opposite a relatively flat or blunt edge 119 as shown, for example, in FIG. 3. The relative angle of cam surface 118 relative to blunt edge 119 may allow for substantially one directional rotation of lid 120 relative to container 110 while container blocking tabs 117 are in a relaxed or non-depressed state. In a relaxed or non-depressed or non-compressed state, in which buttons 116 are not inwardly deflected, lid blockers 125 may be prevented from rotating one direction by the mechanical stop formed between it and blunt edge 119 of container blocking tabs 117. In the same relaxed state, lid blockers may pass by container blocking tabs 117 by gradually sliding over cam surface 118, during which time lid blockers 125 may deflect container blocking tabs 117 inwardly until passed container blocking tabs 117. In this way, a child-resistant opening feature may be provided as a user may need to compress buttons 116 into a compressed or depressed state to remove container blocking tabs 117 and/or blunt edges 119 from the path of lid blockers 125 to allow rotational removal of lid 120 from container 110. Selective rotational opening and closing of lid 120 relative to container 110 may be provided, for example, by a threaded closure mechanism provided by container thread 134 and a lid thread 124.

Lid blockers 125 may be substantially square or rectangular in shape, and/or have opposing flat or blunt surfaces, as shown for example in FIG. 4. These blunt surfaces may form a mechanical stop when abutting container blocking tabs 117, such as at blunt surface 119. It is understood that, while not required, a pair of lid blockers 125 may be included and may be substantially similar or symmetrical in shape. Similarly, a pair of container blocking tabs 117 may be included and may be substantially similar or symmetrical in shape. The pair of lid blockers 125 and/or the pair of container blocking tabs 117 may be diametrically opposed, as shown. Such a diametrically opposed relationship may facilitate actuation by a user by allowing the user to squeeze or compress buttons 116 toward one another and/or may facilitate engagement of lid blockers 125 with container blocking tabs 117 by allowing either lid blocker 125 to engage either container blocking tab 117.

Figure 5:
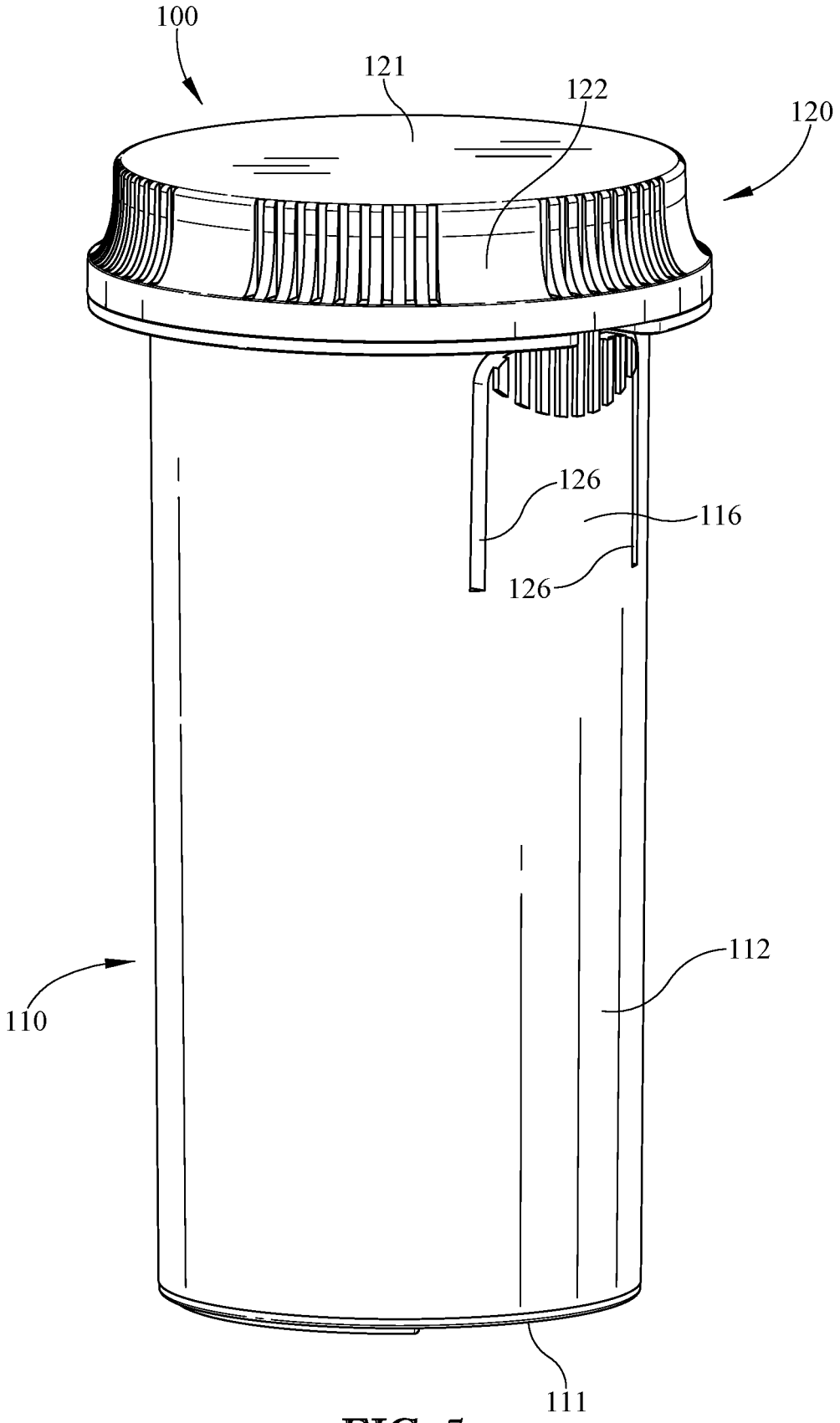
FIG. 5 illustrates a top perspective view of the package of FIG. 1.
Figure 6:
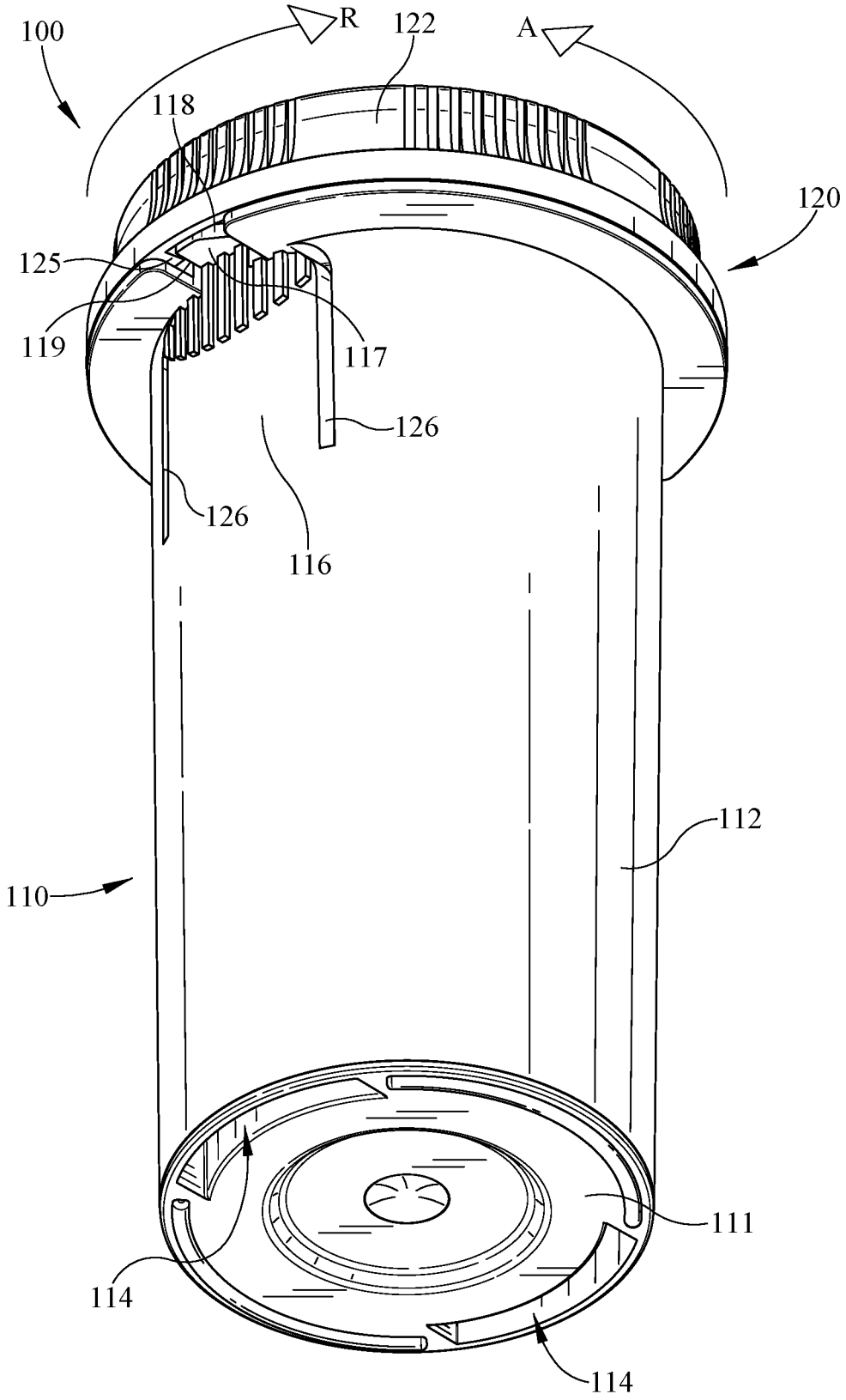
FIG. 6 illustrates another bottom perspective view of the package of FIG. 5, shown in a relaxed state.

As shown in FIGS. 5 and 6, buttons 116 are in a relaxed state, extending upwardly from container wall 112 toward container blocking tab 117. In the relaxed state, container blocking tab is circumferentially aligned with lid blocker 125 to inhibit or prevent rotation of lid 120 relative to container 110 in a removal direction of rotation R by the mechanical stop formed between the flat or blunt surface of lid blocker 125 and the blunt surface 119 of container blocking tab 117. Cam surface 118 is angled or rounded such that lid 120 may be rotated in the opposite direction or attachment direction of rotation A by allowing lid blocker 125 and the blunt surface or flat surface to slide passed cam surface 118.

Figure 7:
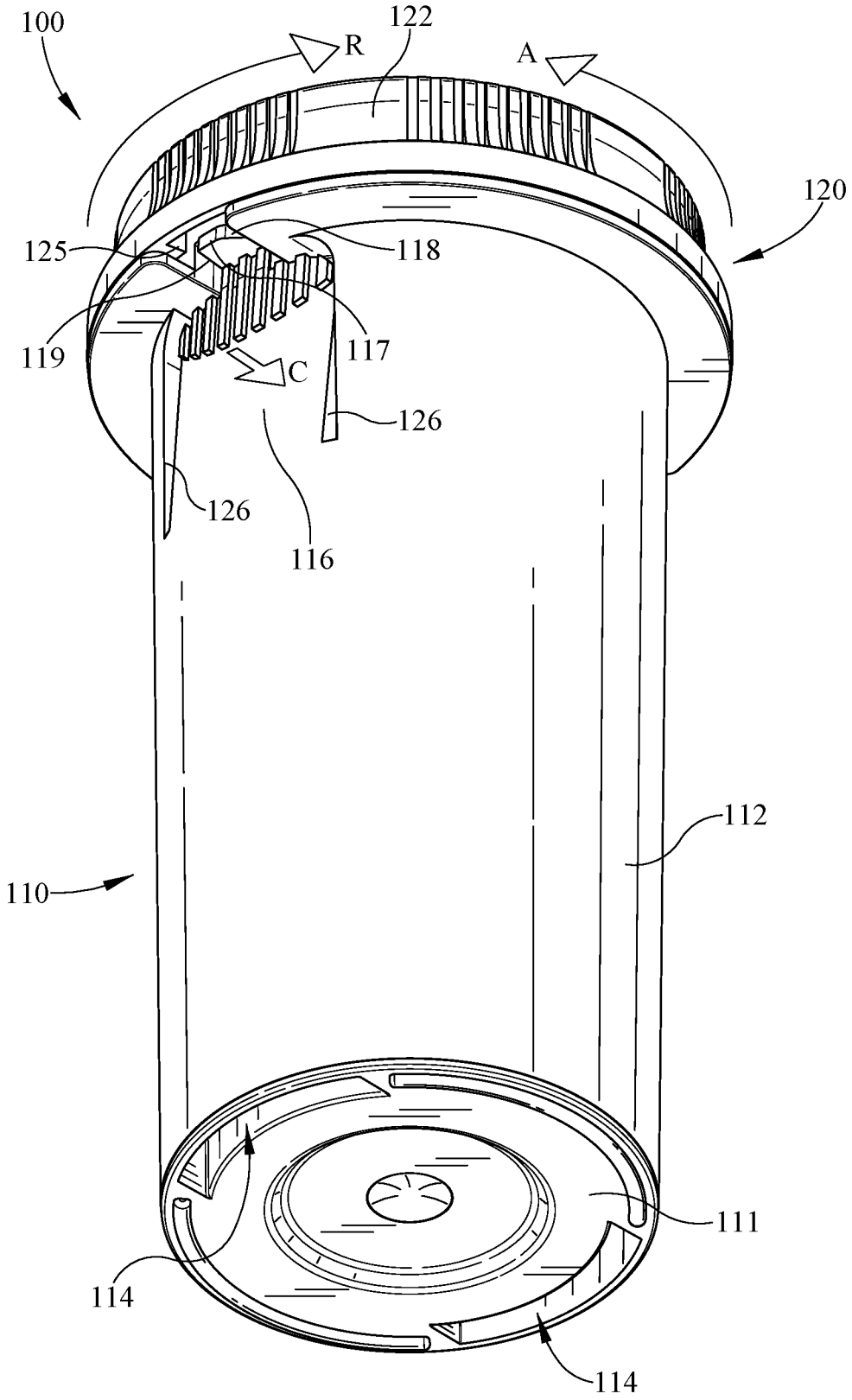
FIG. 7 illustrates the package of FIG. 5 in a compressed state.
Figure 8:
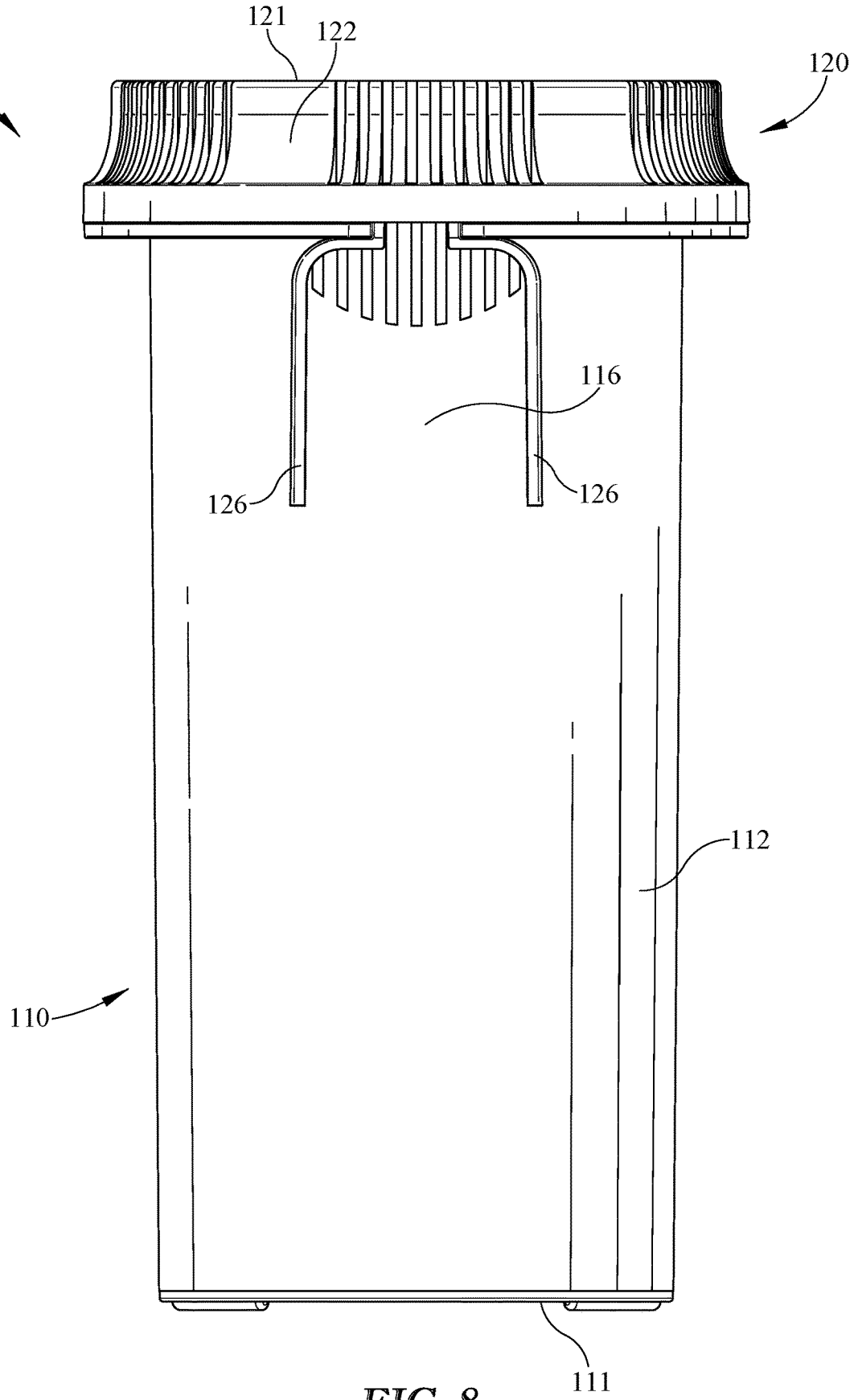
FIG. 8 illustrates a first side view of the package of FIG. 1.
Figure 9:
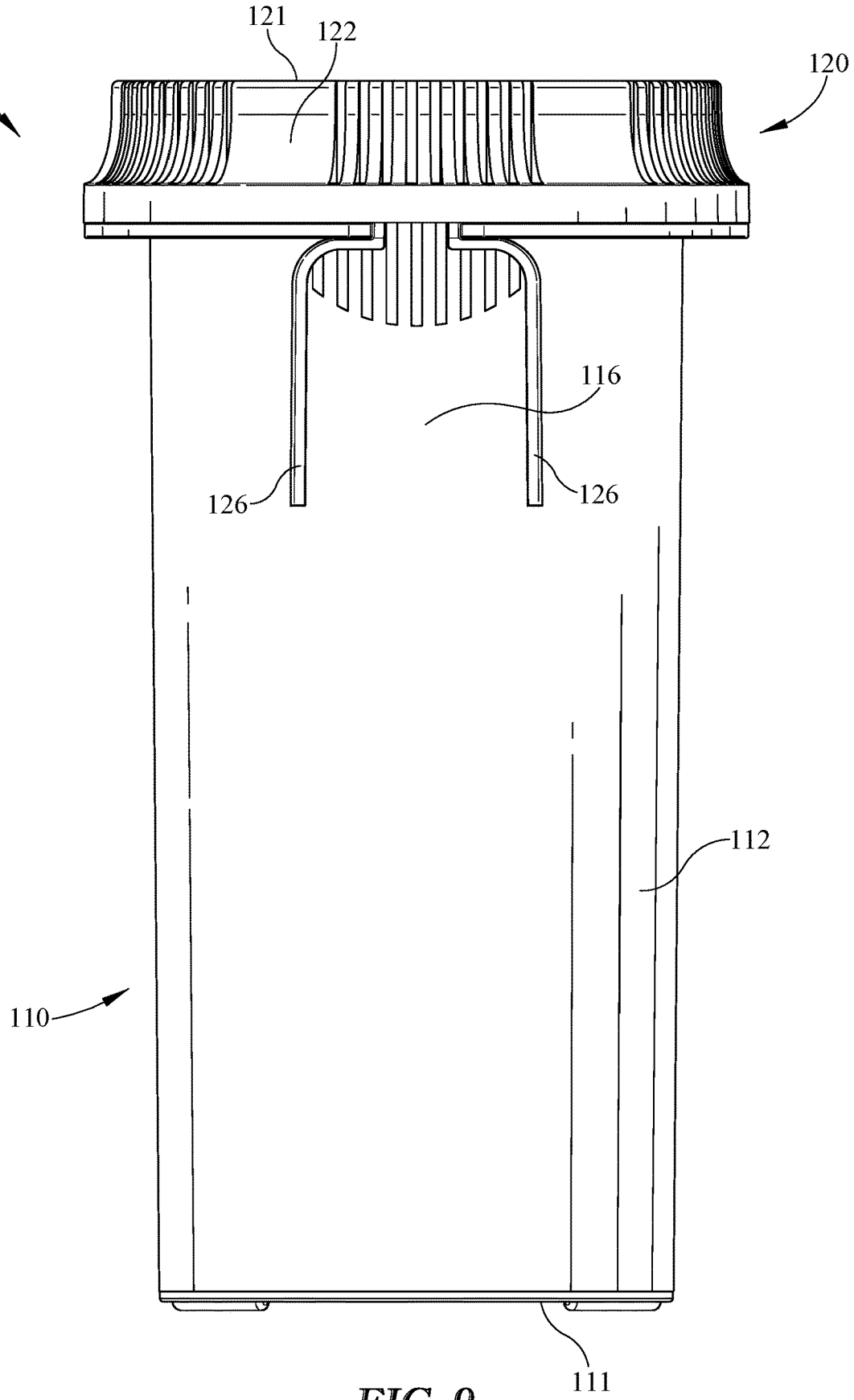
FIG. 9 illustrates a second side view of the package of FIG. 1, which is opposite the first side view of FIG. 7.
Figure 10:
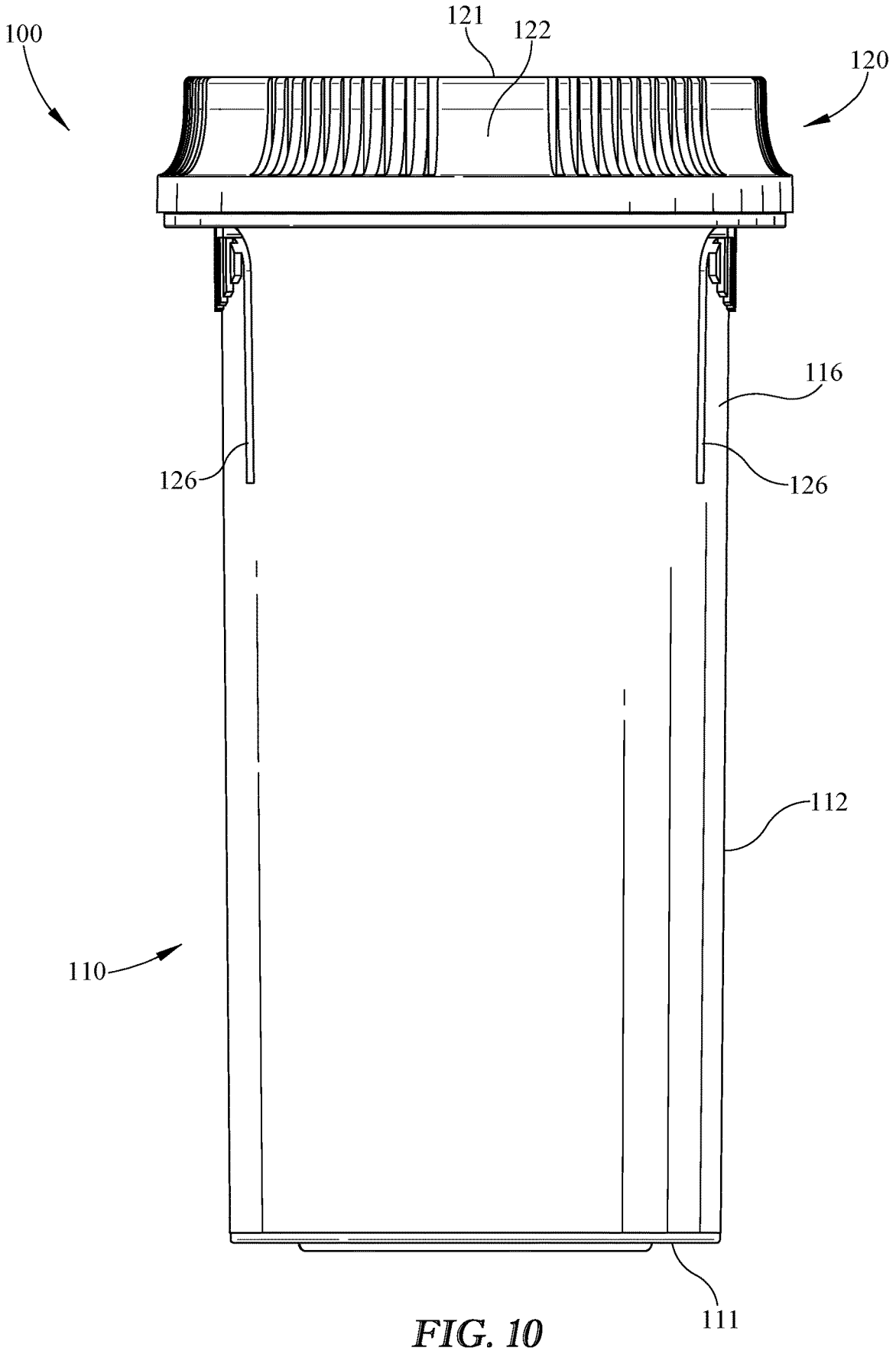
FIG. 10 illustrates a front view of the package of FIG. 1.
Figure 11:
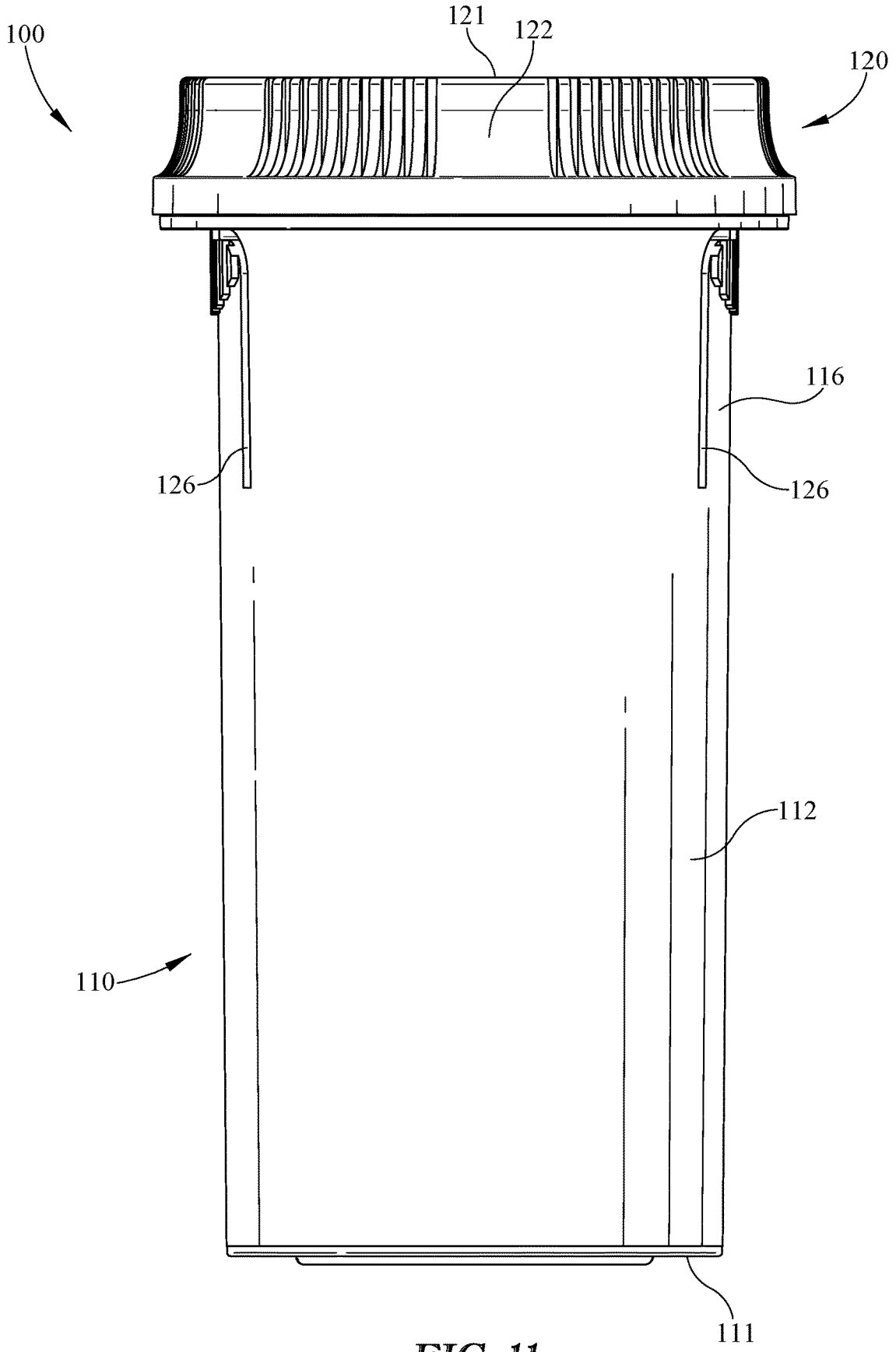
FIG. 11 illustrates a back view of the package of FIG. 1.
Figure 12:
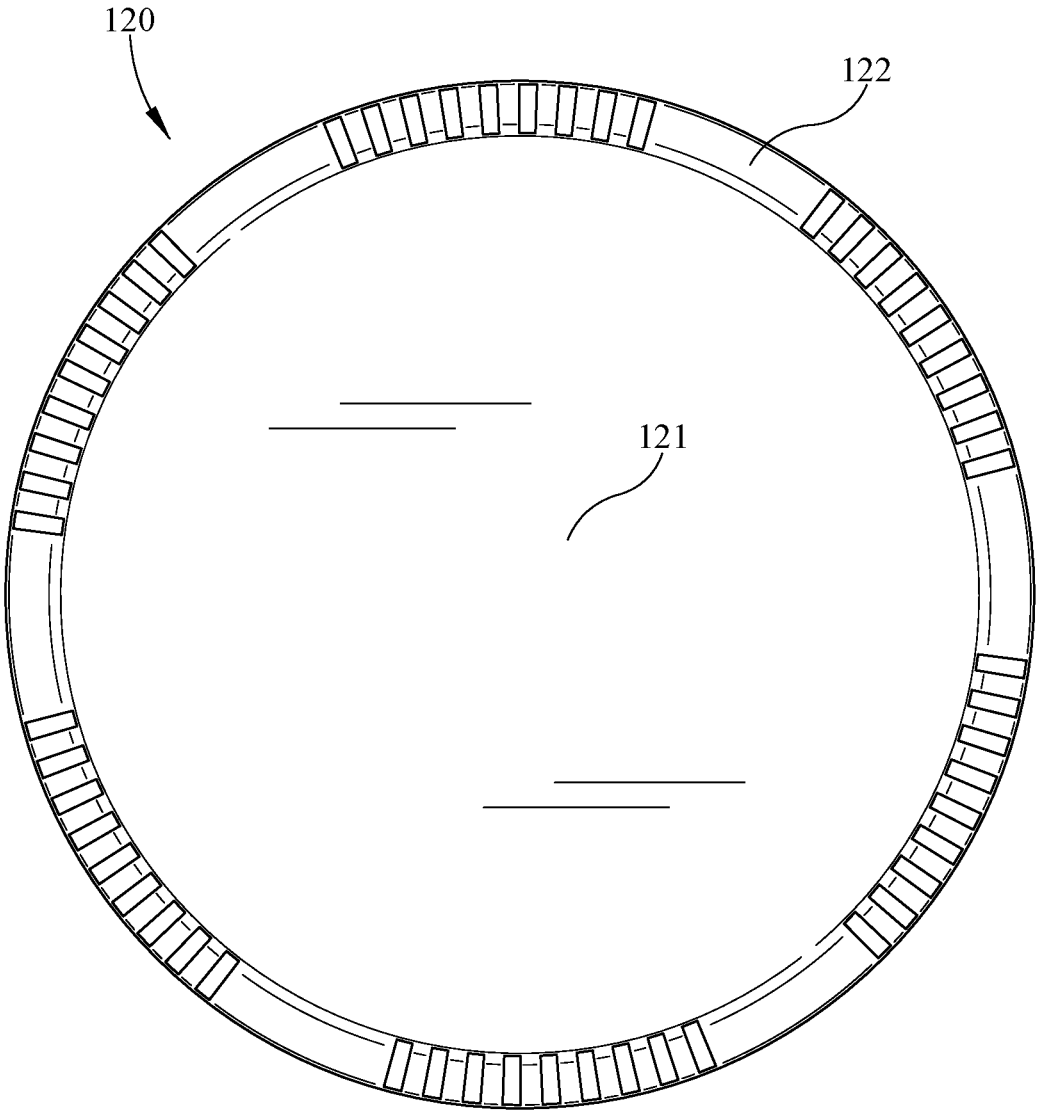
FIG. 12 illustrates a top view of the package of FIG. 1.
Figure 13:
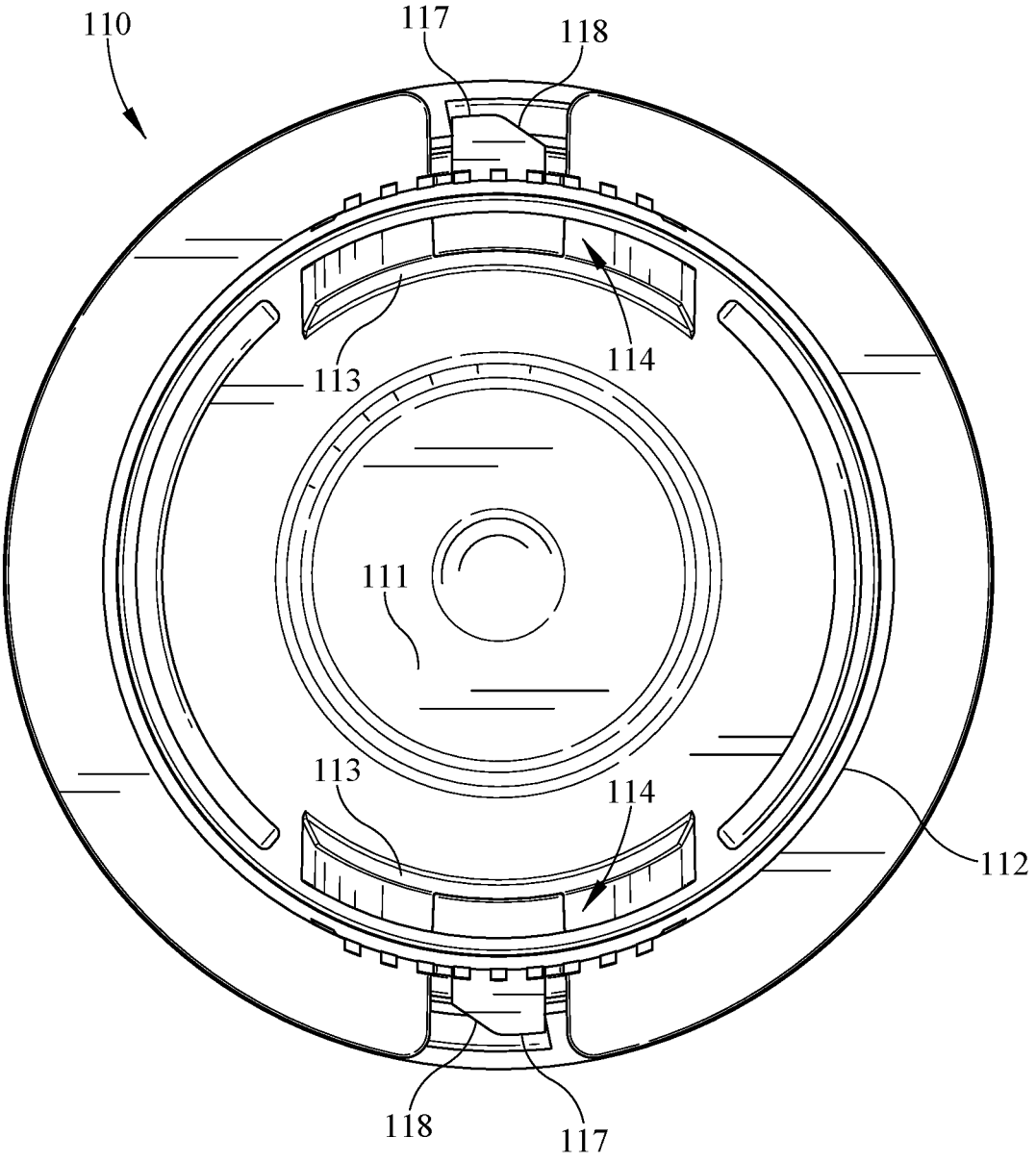
FIG. 13 illustrates a bottom view of the package of FIG. 1.
Figure 14:
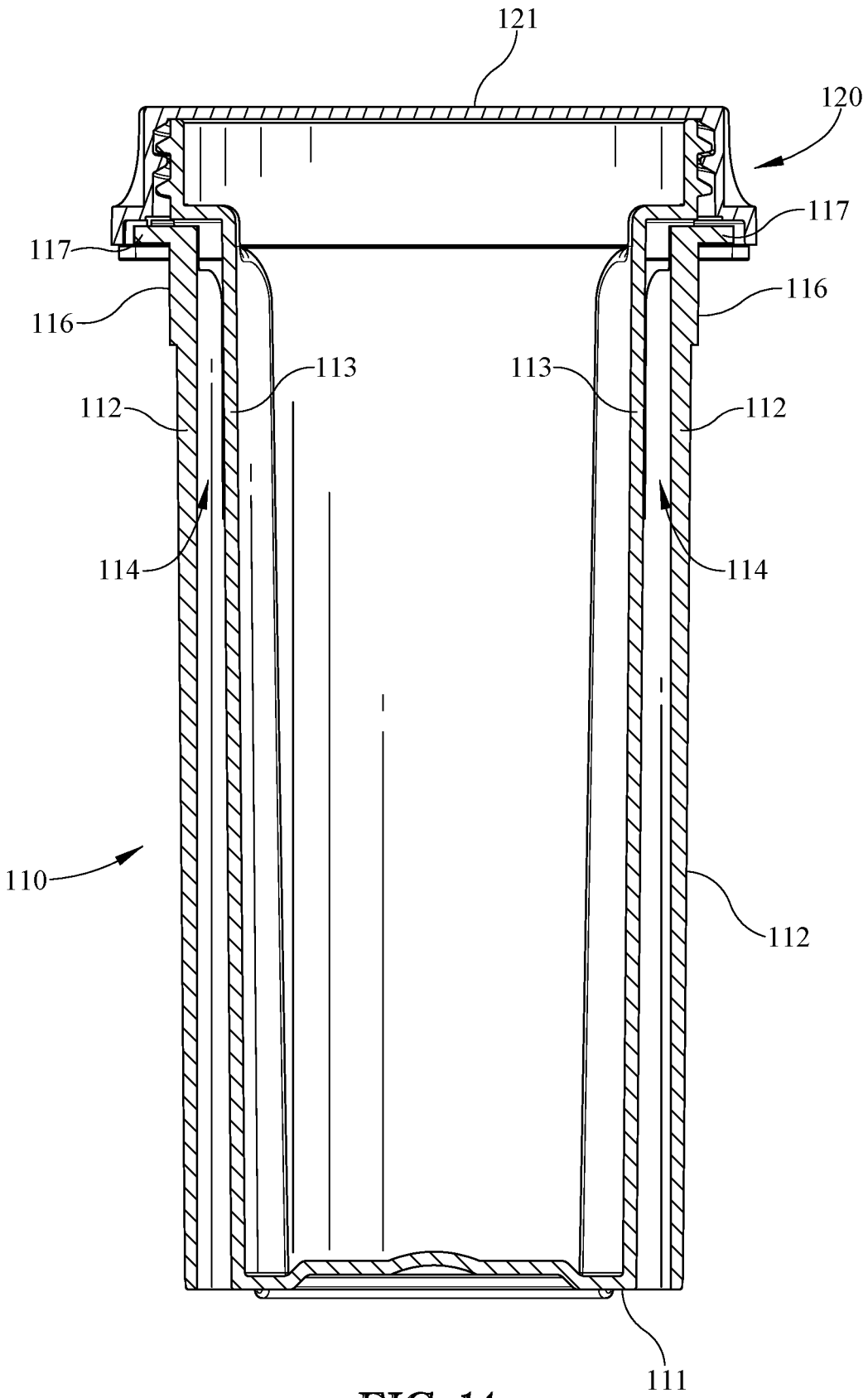
FIG. 14 illustrates a front cross section view of the package of FIG. 1.
Figure 15:
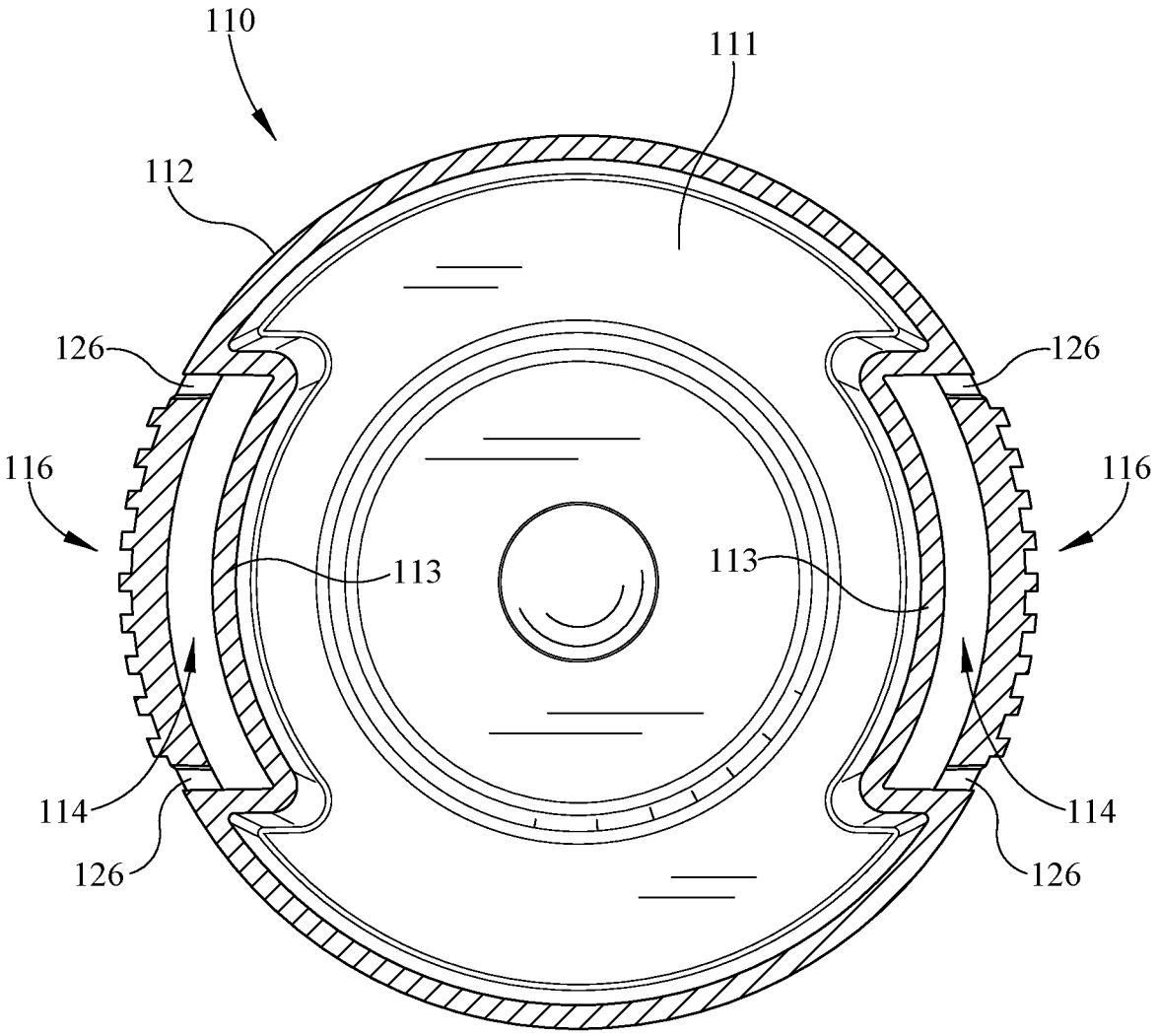
FIG. 15 illustrates a top cross section view of the package of FIG. 1, with the cross section taken through the opposing compressible buttons of the container.

As shown in FIG. 7, buttons 116 are in a compressed state, in which they are being actuated and deflected radially inwardly by an external force, such as a user's squeezing force in compression direction C. In the compressed state, container blocking tabs 117, which are attached to buttons 116, may be moved or deflected radially out of the circumferential path of lid blockers 117 so that lid 120 may be rotated in removal direction R without interference of the blunt surface of lid blocker 125 and the blunt surface 119 of container blocking tab 117. This combination of radially inward squeezing or deflection and rotation may provide a child-resistant yet selectively removable feature of lid 120 relative to container 110.

Button 116 may be at least partially surround by one or more discontinuities or slits 126 in container side wall 112, for example, to facilitate moving button 116 from the relaxed state to the compressed state, as shown in FIGS. 6 and 7. Alternatively, button 116 may be at least partially surrounded by a thinned web of material, mesh, membrane, or other discontinuity that is relatively thinner and/or more flexible than side wall 112 and/or button 126 to create a flexible area between button 116 and side wall 112. If one or more slits 126 are included, it is understood that a path of ingress, egress, or gaseous permeability may be created that otherwise may not exist or be as impermeable as container side wall 112. This could, for example, result in oxygen or other gaseous permeation that could cause or accelerate spoilage of the contents of container 110. To increase impermeability, to prevent debris from entering the product storage region of container 110, to protect and preserve the contents of container 110, and/or for any other reason, a double side wall configuration may be used.

FIGS. 8-14 show package 100, container 110, and lid 120, and components thereof, in more detail from various views. Package 100 may form substantially child-resistant package that may be selectively opened by a user. For example, a user may simultaneously depress or compress a pair of oppositely disposed depressible buttons 116 that are attached to container side wall 112 at the bottom of the buttons 116, and which have container blocking tabs 117 at the top. The user may compress buttons 116 and consequently container blocking tabs 117 from a relaxed state, in which container blocking tabs block rotation of lid 120 by forming a mechanical stop with lid blockers 125, to a compressed state in which buttons 116 and consequently container blocking tabs are radially deflected to remove container blocking tabs 117 from the rotational path of lid blockers 125. In the compressed state, the lid 120 may be removed from container 110 by rotational engagement of container threads 134 and lid threads 124, for example.

For example, container 110 may include a first container side wall 112 and a second container side wall 113, which may define one or more cavities 114 therebetween, as shown for example in FIGS. 2, 3, 14, and 15. Second side wall 113 may be sized, shaped, and/or configured to encapsulate slits 126 and/or partially define cavity 114. Slits 126 may be in fluid communication with cavity 114 and cavity 114 may include openings in container floor 111 so that any ingress of debris or gas or fluid through slits 126 may be communicate through cavity 114 and out of container 110 via openings in floor 111. In this way, slits 126 may be substantially open and/or permeable while the contents in product storage region of container 110 are preserved and protected. Moreover, in this embodiment container 110 may have a substantially uniform outer diameter while also having the double side wall, which may be helpful for example, to maintain a uniform outer diameter that may be helpful in facilitating usage of container 110 with filling machines, printing machines, and/or labeling machines.

Figure 16:
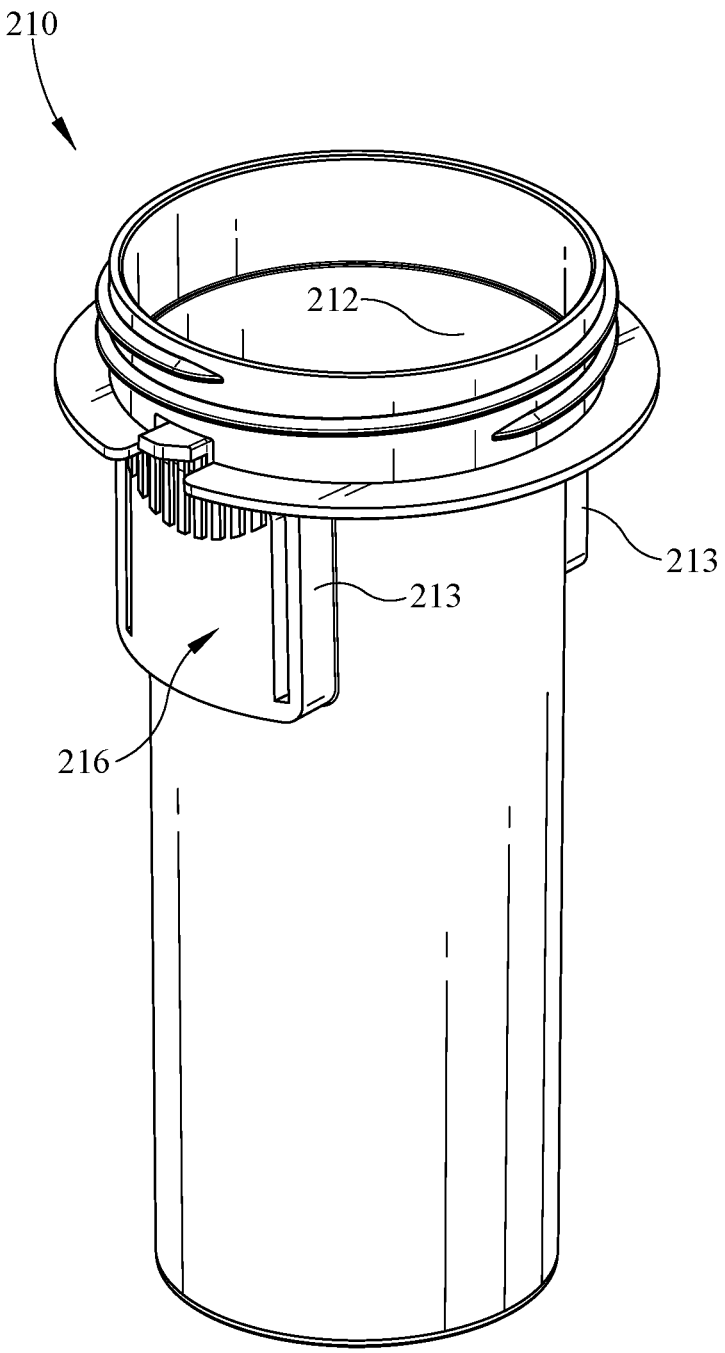
FIG. 16 illustrates a perspective view of an alternative embodiment of a container.
Figure 17:
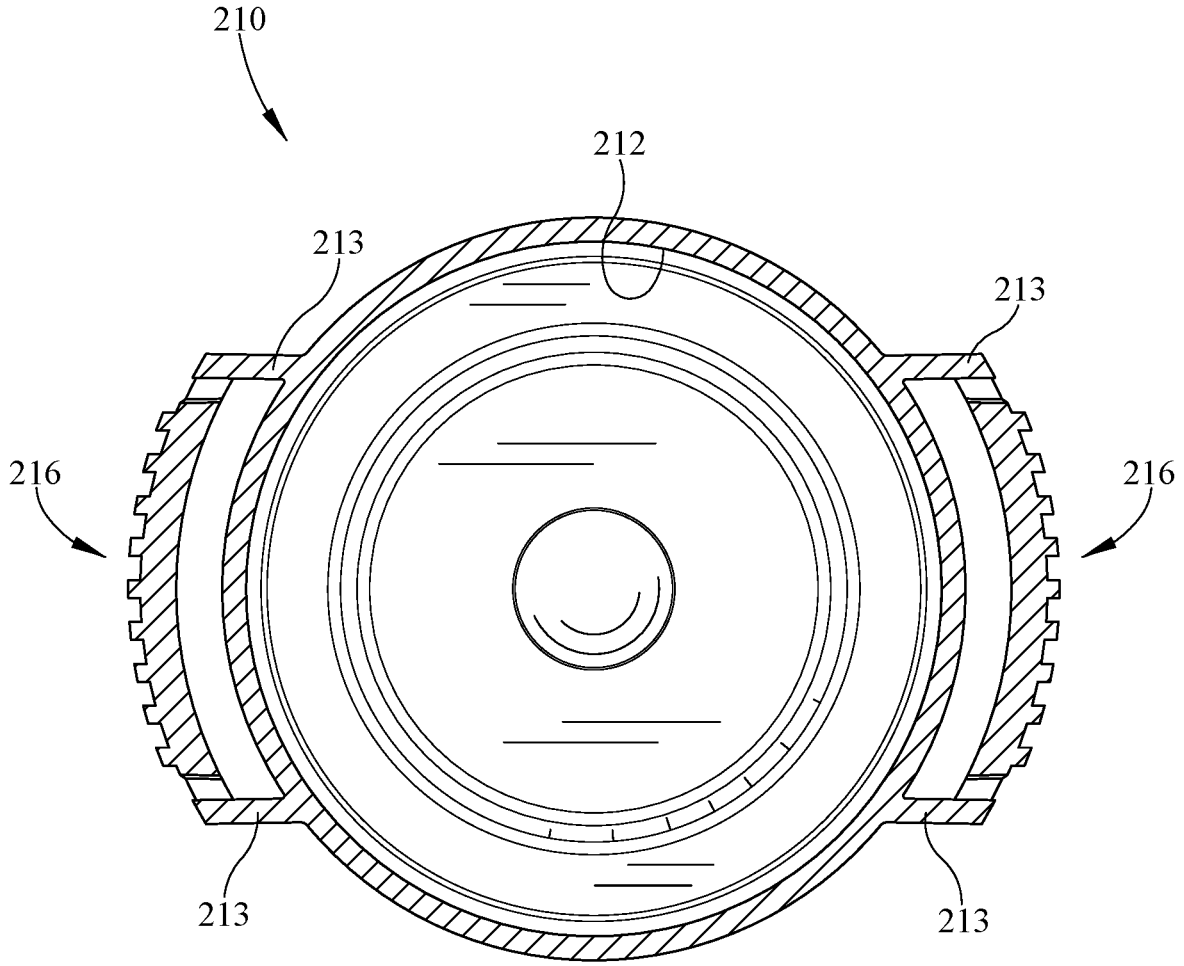
FIG. 17 illustrates a top cross section view of the container of FIG. 15, with the cross section taken through the opposing compressible buttons of the container.

An alternative double side wall container 210 is shown in FIGS. 16 and 17. Container 210 may operate in substantially the same manner as container 110, though it may include a substantially uniform diameter first side wall 212, which may, for example, maximize or optimize the volume inside container 210. This may be done while also maintaining double side wall nature, if desired, by having outwardly projecting second side wall 213 and/or buttons 216 disposed radially outwardly of first or inner side wall 212.

It is understood that package 100, container 110 and/or container 210, lid 120, and/or any component thereof, may be made of any of a variety of materials, including, but not limited to, any of a variety of suitable plastics material, any other material, or any combination thereof. Suitable plastics material may include, but is not limited to, polypropylene (PP), polyethylene (PE), polyethylene terephthalate (PET), polystyrene (PS), high-density polyethylene (HDPE), low-density polyethylene (LDPE), linear low-density polyethylene (LLDPE), crystallized polyethylene terephthalate (CPET), mixtures and combinations thereof, or any other plastics material or any mixtures and combinations thereof. It is understood that multiple layers of material may be used for any of a variety of reasons, including to improve barrier properties, or to provide known functions related to multiple layer structures. The multiple layers, if included, may be of various materials, including but not limited to those recited herein.

It is further understood that package 100, container 110 and/or container 210, lid 120, and/or any component thereof, may be substantially rigid, substantially flexible, a hybrid of rigid and flexible, or any combination of rigid, flexible, and/or hybrid, such as having some areas be flexible and some rigid. It is understood that these examples are merely illustrative, are not limiting, and are provided to illustrate the versatility of options available in various embodiments of package 100, container 110 and/or container 210, lid 120, and/or any component thereof.

It is further understood that any of a variety of processes or combination thereof may be used to form package 100, container 110 and/or container 210, lid 120, and/or any component thereof, or any layer or substrate used therein. For example, any component, layer, or substrate, or combination thereof, may be thermoformed, injection molded, injection stretch blow molded, blow molded, extrusion blow molded, coextruded, subjected to any other suitable process, or subjected to any combination thereof. In some embodiments, package 100, container 110 and/or container 210, lid 120, and/or any component thereof may be formed substantially of injection molded and/or thermoformed suitable plastics material, although other materials and forming processes may be used instead of or in addition to injection molding and thermoforming, respectively. Various materials and/or processes may be used to form package 100, container 110 and/or container 210, lid 120, and/or any component thereof, as will be understood by one of ordinary skill in the art. In some embodiments, container 110 and/or container 210, lid 120, and/or any component thereof, may be substantially a one-piece design and/or substantially formed as an integral or unitary structure.

It is understood that, while some directional terms are used herein, such as top, bottom, upper, lower, inward, outward, upward, downward, etc., these terms are not intended to be limiting but rather to relate to one or more exemplary orientations, positions, and/or configurations of package 100, container 110 and/or container 210, lid 120, and/or any component thereof. It is understood that container 110 and/or container 210, lid 120, and/or any component of package 100, may be oriented differently than shown in the various figures so that, for example, a different portion of container 110 or container 210, other than floor 111 or floor 110, is in contact with an underlying surface.

These and other modifications and variations may be practiced by those of ordinary skill in the art without departing from the spirit and scope, which is more particularly set forth in the appended claims. In addition, it should be understood that aspects of the various embodiments may be interchanged in whole or in part. Furthermore, those of ordinary skill in the art will appreciate that the foregoing description is by way of example only, and it is not intended to limit the scope of that which is described in the claims. Therefore, the spirit and scope of the appended claims should not be limited to the exemplary description of the versions contained herein.

That which is claimed:

1. A package, comprising:

a container having a floor and a first side wall that cooperate to form a product storage region; and a lid that is movable between a closed position in which the lid is blocking access to the product storage region, and an open position in which the product storage region is accessible by a user;

wherein the container includes at least one pair of opposed depressible buttons coupled to at least one pair of container blocking tabs, wherein in a relaxed state the at least one pair of container blocking tabs are configured to retain the lid in a locked state, and in a compressed state the at least one pair of container blocking tabs are configured to allow the lid to move from the closed position to the open position;

wherein the lid includes at least one pair of opposed lid blocking tabs configured to abut the at least one pair of opposed container blocking tabs when the lid is coupled to the container and the at least one pair of opposed container blocking tabs are in the relaxed state;

wherein the container includes at least one second side wall around a cavity formed between the first side wall and the second side wall, wherein each depressible button is at least partially surround by a slit to facilitate depression of that depressible button, and wherein the slit is in fluid communication with the cavity; and wherein the cavity is in fluid communication with an opening in the floor of the container.

2. The package of claim 1, wherein the cavity is in fluid communication with the slit at least partially surrounding the depressible button and the opening in the floor of the container, and wherein the slit, the cavity, and the floor opening are in fluid communication and configured to allow gas and debris that enter the slit to pass through the cavity and exit the container via the floor opening.

3. The package of claim 1, wherein the pair of opposed depressible buttons have an outer diameter that is substantially equal to an outer diameter of the container side wall, wherein the container including the pair of opposed depressible buttons has a substantially uniform outer diameter.

4. The package of claim 1, wherein each container blocking tab of the at least one pair of container blocking tabs projects radially from a top end of a corresponding depressible button of the at least one pair of opposed depressible buttons, and wherein the top end of the corresponding depressible button is opposite a bottom end that is coupled to the container side wall.

5. The package of claim 4, wherein each depressible button is surrounded by a discontinuity of material between it and the container side wall except at the bottom end where the depressible button is coupled to the container side wall.

6. The package of claim 5, wherein the discontinuity is a slit that is substantially absent of material.

7. The package of claim 1, wherein the lid is attachable and removable from the container by rotation of the lid relative to the container.

8. The package of claim 1, wherein each container blocking tab of the at least one pair of container blocking tabs is circumferentially aligned with a corresponding lid blocking tab of the at least one pair of lid blocking tabs when the at least one pair of opposed depressible buttons are in the relaxed state, and in the relaxed state each container blocking tab forms a mechanical stop with the corresponding lid blocking tab to block rotational movement of the corresponding lid blocking tab.

9. The package of claim 1, wherein each container blocking tab is movable radially inwardly relative to a longitudinal axis of the container when each button of the at least one pair of opposed depressible buttons are actuated by a user to the compressed state, and wherein in the compressed state each container blocking tab is removed from circumferential alignment with the corresponding lid blocking tab to allow rotational movement of the lid relative to the container.

10. The package of claim 1, wherein the lid includes an internal thread and the container includes an external thread, and wherein the lid internal thread engages the container external thread to selectively allow rotational attachment and removal of the lid from the container.

11. The package of claim 1, wherein each container blocking tab includes a cam surface that is angled or rounded to allow one-directional passage in a first direction of a corresponding lid blocking tab when the container blocking tab is in the relaxed state, and wherein each container blocking tab includes a blunt surface opposite the cam surface to inhibit passage of the lid blocking tab in a second direction opposite the first direction.

12. A package, comprising:

a container having a floor and a first side wall that cooperate to form a product storage region; and a lid that is movable between a closed position in which the lid is blocking access to the product storage region, and an open position in which the product storage region is accessible by a user;

wherein the container includes at least one pair of opposed depressible buttons coupled to at least one pair of container blocking tabs, wherein in a relaxed state the at least one pair of container blocking tabs are configured to retain the lid in a locked state, and in a compressed state the at least one pair of container blocking tabs are configured to allow the lid to move from the closed position to the open position;

wherein the lid includes at least one pair of opposed lid blocking tabs configured to abut the at least one pair of opposed container blocking tabs when the lid is coupled to the container and the at least one pair of opposed container blocking tabs are in the relaxed state;

wherein the container includes at least one second side wall around a cavity formed between the first side wall and the second side wall, wherein each depressible button is at least partially surround by a slit to facilitate depression of that depressible button, and wherein the slit is in fluid communication with the cavity;

wherein the second side wall and each depressible button has an outside diameter greater than an outside diameter of the first side wall of the container; and wherein the cavity is in fluid communication with an opening in the floor of the container.

13. The package of claim 12, wherein the inner side wall has a substantially uniform inner diameter.

14. The package of claim 12, wherein the cavity is in fluid communication with the slit at least partially surrounding the depressible button and the opening in the floor of the container, and wherein the slit, the cavity, and the floor opening are in fluid communication and configured to allow gas and debris that enter the slit to pass through the cavity and exit the container via the floor opening.

* * * * *